US010957468B2

(12) United States Patent
Ranganathan et al.

(10) Patent No.: US 10,957,468 B2
(45) Date of Patent: Mar. 23, 2021

(54) COATED OVERHEAD CONDUCTORS AND METHODS

(71) Applicant: General Cable Technologies Corporation, Highland Heights, KY (US)

(72) Inventors: Sathish K. Ranganathan, Plainfield, IN (US); Vijay Mhetar, Carmel, IN (US); Cody R. Davis, Maineville, OH (US); Srinivas Siripurapu, Carmel, IN (US)

(73) Assignee: GENERAL CABLE TECHNOLOGIES CORPORATION, Highland Heights, KY (US)

( * ) Notice: Subject to any disclaimer, the term of this patent is extended or adjusted under 35 U.S.C. 154(b) by 247 days.

(21) Appl. No.: 14/185,429

(22) Filed: Feb. 20, 2014

(65) Prior Publication Data

US 2014/0238867 A1 Aug. 28, 2014

Related U.S. Application Data

(60) Provisional application No. 61/769,492, filed on Feb. 26, 2013.

(51) Int. Cl.
*H01B 7/42* (2006.01)
*C25D 7/06* (2006.01)
(Continued)

(52) U.S. Cl.
CPC ..... *H01B 7/421* (2013.01); *C25D 7/0607* (2013.01); *C25D 11/02* (2013.01); *C25D 11/022* (2013.01);
(Continued)

(58) Field of Classification Search
CPC ..... H01B 7/421; H01B 9/008; H01B 5/00; H01B 5/08; H01B 5/10;
(Continued)

(56) References Cited

U.S. PATENT DOCUMENTS 2,421,652 A * 6/1947 Robinson ..... C25B 13/00 174/110 A
2,650,975 A 9/1953 Dorst
(Continued)

FOREIGN PATENT DOCUMENTS

CL 3425-2008 11/2008
CN 101002288 A 7/2007
(Continued)

OTHER PUBLICATIONS

English Translation of Han (CN101752023) provided with office action.*
(Continued)

*Primary Examiner* — Roshn K Varghese
(74) *Attorney, Agent, or Firm* — Ulmer & Berne LLP

(57) ABSTRACT

A coated overhead conductor having an assembly including one or more conductive wires, such that the assembly includes an outer surface coated with an electrochemical deposition coating forming an outer layer, wherein the electrochemical deposition coating includes a first metal oxide, such that the first metal oxide is not aluminum oxide. Methods for making the overhead conductor are also provided.

16 Claims, 2 Drawing Sheets

(51) Int. Cl.

| | |
|---|---|
| ***H01B 3/10*** | (2006.01) |
| ***C25D 11/02*** | (2006.01) |
| ***C25D 11/06*** | (2006.01) |
| ***C25D 11/08*** | (2006.01) |
| *H01B 5/00* | (2006.01) |

(52) U.S. Cl.
CPC ..... *C25D 11/024* (2013.01); *C25D 11/06* (2013.01); *C25D 11/08* (2013.01); *H01B 3/105* (2013.01); *C25D 11/026* (2013.01); *H01B 5/002* (2013.01)

(58) Field of Classification Search
CPC .. H01B 5/101–108; H01B 5/12; H01B 3/105; H01B 3/10; H01B 3/008; H01B 3/12; H01B 5/002; C25D 11/024; C25D 11/02; C25D 11/06; C25D 11/022; C25D 11/08; C25D 11/026; C25D 7/0607; H02G 1/02
USPC ..... 174/40 R
See application file for complete search history.

(56) References Cited

U.S. PATENT DOCUMENTS 3,278,673 A 10/1966 Gore
3,383,188 A 5/1968 Michelson et al.
3,787,711 A 1/1974 Bright
3,895,956 A 7/1975 Yoshida et al.
4,149,367 A 4/1979 Eistrat
4,288,252 A 9/1981 Neely
4,288,974 A 9/1981 Eistrat
4,347,285 A 8/1982 Batdorf
4,358,637 A 11/1982 Lanfranconi
4,369,204 A * 1/1983 Wolf ..... H01B 13/065 427/126.6
4,383,133 A 5/1983 Lanfranconi
4,407,062 A 10/1983 Sutcliffe et al.
4,463,219 A 7/1984 Sato
4,513,173 A 4/1985 Merry
4,575,184 A 3/1986 Ueno et al.
4,755,629 A 7/1988 Beggs et al.
4,762,753 A 8/1988 Perfetti
4,784,461 A 11/1988 Abe et al.
4,912,286 A * 3/1990 Clarke ..... C01G 23/043 174/110 A
5,066,330 A 11/1991 Holcombe, Jr. et al.
5,091,609 A * 2/1992 Sawada ..... C23C 18/1216 427/123
5,164,003 A 11/1992 Bosco et al.
5,177,809 A 1/1993 Zeidler et al.
5,194,087 A 3/1993 Berg
5,296,288 A 3/1994 Kourtides et al.
5,310,422 A 5/1994 Abdel-Latif
5,330,794 A 7/1994 Bosco et al.
5,336,851 A * 8/1994 Sawada ..... H01B 3/105 174/110 A
5,350,638 A 9/1994 Sawada et al.
5,372,886 A * 12/1994 Inazawa ..... H01B 3/105 174/110 A
5,468,290 A 11/1995 Kelley
5,554,826 A * 9/1996 Gentry ..... H01B 5/104 174/128.1
5,828,007 A 10/1998 Fujishita et al.
6,007,873 A 12/1999 Holcombe, Jr. et al.
6,013,372 A 1/2000 Hayakawa et al.
6,136,434 A * 10/2000 Jang ..... C09D 5/18 174/110 A
6,239,379 B1 5/2001 Cotter et al.
6,295,401 B1 9/2001 Rutterman et al.
6,362,121 B1 3/2002 Chopin et al.
6,589,661 B2 7/2003 Neely, Jr.
6,687,437 B1 2/2004 Starnes et al.
6,797,147 B2 9/2004 Dolan
6,916,414 B2 7/2005 Dolan
6,921,431 B2 7/2005 Evans et al.
6,973,243 B2 12/2005 Koyasu et al.
7,015,395 B2 3/2006 Goldsworthy et al.
7,093,416 B2 8/2006 Johnson et al.
7,105,047 B2 9/2006 Simmons et al.
7,244,470 B2 7/2007 Niles
7,313,909 B2 1/2008 Skoog et al.
7,354,650 B2 4/2008 Nakajima et al.
7,438,791 B2 10/2008 Sakayanagi
7,438,971 B2 10/2008 Bryant et al.
7,449,245 B2 11/2008 Akarsu et al.
7,534,964 B2 5/2009 Clark et al.
7,612,289 B2 11/2009 Lique et al.
7,643,713 B2 1/2010 Buthe et al.
7,752,754 B2 7/2010 Goldsworthy et al.
7,820,300 B2 10/2010 Dolan
7,834,271 B2 11/2010 Gromko et al.
7,897,875 B2 3/2011 Gareis
7,954,518 B2 6/2011 Torrance et al.
8,204,348 B2 6/2012 Keller et al.
8,295,665 B2 10/2012 Herbest
8,319,104 B2 11/2012 Camp, II et al.
8,361,630 B2 1/2013 Dolan
8,625,946 B2 1/2014 Kachmar
8,718,428 B2 5/2014 Hurley et al.
9,011,791 B2 4/2015 Olver et al.
2004/0016503 A1 1/2004 Stowe
2005/0061680 A1* 3/2005 Dolan ..... C25D 5/18 205/322
2005/0064094 A1 3/2005 Wojtysiak et al.
2005/0279074 A1 12/2005 Johnson et al.
2005/0279527 A1* 12/2005 Johnson ..... H01B 13/0235 174/106 R
2006/0237221 A1 10/2006 Glew
2007/0148479 A1 6/2007 Ishikazi et al.
2007/0193767 A1 8/2007 Guery et al.
2007/0193769 A1 8/2007 Clark et al.
2008/0128155 A1 6/2008 Guery et al.
2008/0210567 A1 9/2008 Karuppuchamy et al.
2008/0264670 A1 10/2008 Glew
2009/0078439 A1 3/2009 Wiekhorst
2009/0114420 A1 5/2009 Winterhalter
2009/0126971 A1 5/2009 Fok
2009/0196986 A1 8/2009 Cordaro et al.
2009/0293786 A1 12/2009 Olver
2010/0076719 A1 3/2010 Lawry et al.
2010/0252241 A1 10/2010 McDermott et al.
2012/0074122 A1 3/2012 Olver et al.
2012/0090892 A1 4/2012 Meyer et al.
2012/0106591 A1 5/2012 Springer, III
2012/0141778 A1 6/2012 Phipps
2012/0172209 A1 7/2012 Lu et al.
2012/0222883 A1 9/2012 Nordin et al.
2012/0267141 A1 10/2012 Kamiyama et al.
2012/0312579 A1 12/2012 Kenny et al.
2013/0014972 A1 1/2013 Wiebelhaus et al.
2014/0041925 A1 2/2014 Davis et al.
2014/0238867 A1 8/2014 Ranganathan et al.
2015/0104641 A1 4/2015 Mhetar et al.
2015/0235739 A1 8/2015 Davis et al.

FOREIGN PATENT DOCUMENTS

CN 200979826 Y 11/2007
CN 101125979 A 2/2008
CN 101752023 A 6/2010
CN 2011773611 U 3/2011
CN 101752023 B 9/2011
CN 102304742 A 1/2012
CN 102439093 A 5/2012
CN 102446578 A 5/2012
CN 102471637 A 5/2012
CN 102977700 A 3/2013
CN 203038717 U 7/2013
DE 3824608 C1 8/1989
DE 9410584 9/1994
EP 0756289 A1 1/1997
EP 0981192 A1 2/2000
EP 2544190 A1 1/2013

(56) References Cited

FOREIGN PATENT DOCUMENTS

| | | | |
|---|---|---|---|
| ES | 2015171 | A6 | 8/1990 |
| FR | 2971617 | A1 | 8/2012 |
| GB | 437310 | | 10/1935 |
| GB | 2079521 | A | 1/1982 |
| GB | 2123164 | | 1/1984 |
| JP | S48-70874 | | 9/1973 |
| JP | S50-40708 | | 4/1975 |
| JP | S55-162810 | | 5/1980 |
| JP | S57-180808 | A | 11/1982 |
| JP | S58-73512 | U | 5/1983 |
| JP | H04-075206 | A | 3/1992 |
| JP | 6-162828 | A | 6/1994 |
| JP | H08-235940 | A | 9/1996 |
| JP | 8-315653 | A | 11/1996 |
| JP | 2000-243143 | A | 9/2000 |
| JP | 2001-52539 | | 2/2001 |
| JP | 2003-132746 | | 5/2003 |
| JP | 2009-026699 | A | 2/2009 |
| MX | 2011009259 | A | 8/2012 |
| RU | 2386183 | C1 | 4/2010 |
| WO | 85/00462 | A1 | 1/1985 |
| WO | 99/048182 | A1 | 9/1999 |
| WO | 2004109797 | A1 | 12/2004 |
| WO | 2005005680 | A2 | 1/2005 |
| WO | WO-2006136335 | A1 | 12/2006 |
| WO | 2007034248 | A1 | 3/2007 |
| WO | 2010042191 | A1 | 4/2010 |

OTHER PUBLICATIONS

Schedrina, O.; International Search Report and Written Opinion of the International Searching Authority, issued in International application No. PCT/US2013/037433; dated Aug. 8, 2013; 5 pages.
Kim, Tae Hoon; International Search Report and Written Opinion of the International Searching Authority, issued in International application No. PCT/US2014/017736; dated May 20, 2014; 13 pages.
Song, Li; Second Office Action issued in Chinese Patent Application No. 201380053188.X; dated Jan. 26, 2017; 8 pages, including English translation.
Gonzalez, Cecilia Veronica Lanas; Office Action issued in Chilean Patent Application No. 0320-2015; dated Feb. 3, 2017; 18 pages, including English translation.
Sanchez, Ronaldo; Examination Report No. 1 for Standard Patent Application, issued in Australian Patent Application No. 2014223867; dated Feb. 10, 2017; 3 pages.
Vanier, Cecile; Extended European Search Report, including supplementary European search report and European search opinion, issued in European Patent Application No. 14756868.7; dated Aug. 16, 2016; 6 pages.
Gnanasingham, Soosa; Patent Examination Report No. 1 issued in Australian Patent Application No. 2013300127; dated Jul. 22, 2016; 4 pages.
Lopez, Ricardo E.; Non-Final Office Action issued in U.S. Appl. No. 14/701,220; dated Oct. 21, 2016; 14 pages.
Vargas, Hector Javier Sanchez; Office Action issued in Mexican Patent Application No. Mx/a/2015/001771; dated Jun. 14, 2016; 11 pages, including English translation.
Young, Lee W.; International Search Report and Written Opinion of the International Searching Authority, issued in International Application No. PCT/US2016/043429; dated Oct. 13, 2016; 7 pages.
Zhang, Qiuhong; First Office Action and Search Report issued in Chinese Patent Application No. 201380053188.X; dated Mar. 31, 2016; 27 pages including English translation.
Hillmayr, Heinrich; Extended European Search Report, including supplementary European search report and European search opinion, issued in European Patent Application No. 13827181.2; dated Mar. 16, 2016; 9 pages.
Copenheaver, Blaine R.; International Search Report and Written Opinion of the International Searching Authority issued in International Application No. PCT/US2014/062181; dated Feb. 9, 2015; 9 pages.
Thomas, Shane; International Search Report and Written Opinion of the International Searching Authority issued in International Application No. PCT/US2015/010619; dated Mar. 25, 2015; 8 pages.
Thomas, Shane; International Search Report and Written Opinion of the International Searching Authority issued in International Application No. PCT/US2015/035137; dated Sep. 4, 2015; 9 pages.
Thomas, Shane; International Search Report and Written Opinion of the International Searching Authority issued in International Application No. PCT/US2015/010637; dated Mar. 25, 2015; 9 pages.
Murata, Austin; Non-Final Office Action issued in U.S. Appl. No. 13/863,902; dated Jun. 27, 2017; 15 pages.
Vargas, Hector Javier Sanchez; Office Action issued in Mexican Patent Application No. MX/a/2015/001771; dated Dec. 7, 2016; 14 pages, including English translation.
Akagashi, Yuki; Notice of Reasons for Rejection issued in Japanese Patent Application No. 2015-526528; dated Dec. 19, 2016; 11 pages, including English translation.
Gonzalez; Cecilia Veronica Lanas; Office Action issued in Chilean Patent Application No. 2015-000320; dated Jul. 27, 2016; 17 pages, including English translation.
Campos M., Celia; Examination Report issued in Chilean Patent Application No. 2015-2382; dated Jun. 19, 2017; 22 pages, including English translation.
Office Action issued in Taiwanese Patent Application No. 102138290; dated Jul. 28, 2017; 14 pages, including English translation.
Zhang, Qiuhong; Office Action issued in Chinese Patent Application No. 201380053188.X; dated Aug. 14, 2017; 17 pages, including English translation.
Paden, Leodelino C.; Substantive Examination Report issued in Philippines Patent Application No. 1-2015-500273; dated Sep. 5, 2017; 2 pages.
Office Action issued in Taiwanese Patent Application No. 103106557; dated May 8, 2018; 32 pages including English translation.
Office Action issued in Taiwanese Patent Application No. 103106557; dated Dec. 6, 2018; 24 pages including English translation.
Andrade Meneses, Ociel Esau; Office Action issued in Mexican Patent Application No. MX/a/2015/010959; dated Jul. 3, 2019; 7 pages including partial English translation.
Andrade Meneses, Ociel Esau; Office Action issued in Mexican Patent Application No. MX/a/2015/010959; dated Dec. 6, 2019; 5 pages including partial English translation.
Andrade Meneses, Ociel Esau; Office Action issued in Mexican Patent Application No. MX/a/2015/010959; dated Jul. 14, 2020; 6 pages including partial English translation.
Sato, Takahiko; Notice of Reasons for Rejection issued in Japanese Patent Application No. 2015-559003; dated Jan. 15, 2018; 9 pages including English translation.
Sato, Takahiko; Notice of Reasons for Rejection issue in Japanese Patent Application No. 2015-559003; dated Nov. 26, 2018; 9 pages including English translation.
First Examination Report issued in Indian Patent Application No. 2831/KOLNP/2015; dated Jun. 28, 2019; 6 pages.
Vanier, Cecile; Office Action issued in European Patent Application No. 14756868.7; dated Nov. 14, 2018; 5 pages.
Vanier, Cecile; Office Action issued in European Patent Application No. 14756868.7; dated May 14, 2019; 5 pages.
Campos, Cecilia; Office Action issued in Chilean Patent Application No. 2015-2382; dated Jan. 8, 2018; 10 pages including partial English machine translation.
Todt Seelig, Bernardo Henrique; Preliminary Office Action issued in Brazilian Patent Application No. 112015020321-3; dated Jan. 8, 2020; 6 pages including partial English translation.
Do Carmo, Jorge Falcao; Office action issued in Brazilian Patent Application No. 112015020321-3; dated Apr. 23, 2020; 5 pages including partial English translation.
Lopez, Ricardo; Final Office Action issued in U.S. Appl. No. 14/701,220; dated Jul. 13, 2017; 8 pages.
Alaqil; Saleh M.; Examination Report issued in GCC Patent Application No. 2013-25627; dated Feb. 8, 2017; 4 pages.
Alvear, Mariana Olimpia Castro; Office Action issued in Mexican Patent Application No. MX/a/2015/001771; dated Jun. 27, 2017; 16 pages, including English translation.

(56) References Cited

OTHER PUBLICATIONS

Sanchez, Ronaldo; Examination Report No. 2, issued in Australian Patent Application No. 2014223867; dated Jan. 30, 2018; 3 pages.

* cited by examiner

COATED OVERHEAD CONDUCTORS AND METHODS

CROSS-REFERENCE TO RELATED APPLICATION

The present application claims priority of U.S. provisional application Ser. No. 61/769,492, filed Feb. 26, 2013, and hereby incorporates the same application herein by reference in its entirety.

TECHNICAL FIELD

The present disclosure generally relates to a coated overhead conductor which better radiates heat away, thereby reducing operating temperature.

BACKGROUND

As the need for electricity continues to grow, the need for higher capacity transmission and distribution lines grows as well. The amount of power a transmission line can deliver is dependent on the current-carrying capacity (ampacity) of the line. For a given size of the conductor, the ampacity of the line is limited by the maximum safe operating temperature of the bare conductor that carries the current. Exceeding this temperature can result in damage to the conductor or the accessories of the line. Moreover, the conductor gets heated by Ohmic losses and solar heat and cooled by conduction, convection and radiation. The amount of heat generated due to Ohmic losses depends on current (I) passing through the conductor and its electrical resistance (R) by the relationship—Ohmic losses=$I^2R$. Electrical resistance (R) itself depends on temperature. Higher current and temperature lead to higher electrical resistance, which, in turn, leads to more electrical losses in the conductor.

SUMMARY

In accordance with one embodiment, a coated overhead conductor includes an assembly including one or more conductive wires. The assembly also includes an outer surface coated with an electrochemical deposition coating forming an outer layer. The electrochemical deposition coating includes a first metal oxide. The first metal oxide is not aluminum oxide.

In accordance with another embodiment, a method of making a coated overhead conductor includes providing a bare conductor and performing electrochemical deposition of a first metal oxide on an outer surface of the bare conductor to form an outer layer on the bare conductor. The outer layer includes an electrochemical deposition coating. The first metal oxide is not aluminum oxide.

In accordance with yet another embodiment, a coated overhead conductor includes an assembly including one or more conductive wires. The one or more conductive wires are formed of aluminum or aluminum alloy. The assembly includes an outer surface coated with an electrochemical deposition coating forming an outer layer. The electrochemical deposition coating includes titanium oxide, zirconium oxide or combinations thereof. The outer layer has a thickness from about 5 microns to about 25 microns.

BRIEF DESCRIPTION OF THE DRAWINGS

Various embodiments will become better understood with regard to the following description, appended claims and accompanying drawings wherein:

DETAILED DESCRIPTION

Figure 1:
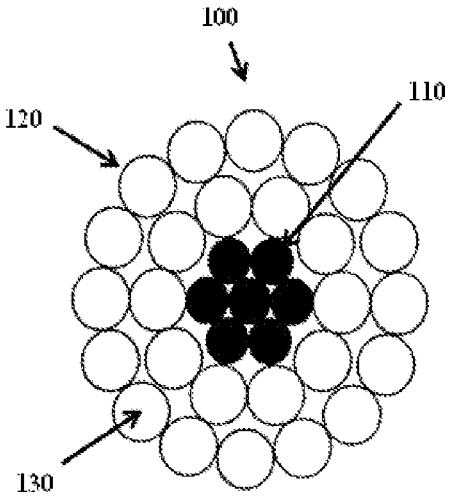
FIG. 1 is a cross-sectional view of an overhead conductor in accordance with one embodiment.

Selected embodiments are hereinafter described in detail in connection with the views and examples of FIGS. 1-5.

Metal oxide coated overhead conductors, when tested in under similar current and ambient conditions, can have a reduced operating temperature by at least 5° C. compared to the temperature of the same conductor without the surface modification.

Accordingly, it can be desirable to provide a modified overhead conductor that operates at significantly lower temperatures compared to an unmodified overhead conductor that operates under the same operating conditions, such as current and ambient conditions. Such a modified overhead conductor can have a coating of metal oxide other than aluminum oxide, such that when tested under similar current and ambient conditions, has a reduced operating temperature by at least 5° C. compared to the operating temperature of the same conductor without the coating. At higher operating temperatures, e.g. above 100° C., a coated conductor can have a reduction of at least 10° C. when compared to an uncoated conductor when tested under similar current and ambient conditions (e.g., operating conditions).

Overhead conductors can be coated using a variety of techniques; however, one advantageous method includes coating the overhead conductor via electrochemical deposition with a metal oxide on the surface of the overhead conductor. The method can contain the steps of:

a) Pretreatment: cleaning and preparing the surface of the overhead conductor;
b) Coating: coating the surface of overhead conductor with metal oxide coating using electrochemical deposition;
c) Rinsing (optional); and
d) Drying: drying the coated overhead conductor in air or in an oven.

Suitable pre-treatment for a surface of an overhead conductor can include hot water cleaning, ultrasonic, de-glaring, sandblasting, chemicals (like alkaline or acidic), and others or a combination of the above methods. The pre-treatment process can be used to remove dirt, dust, and oil for preparing the surface of the overhead conductor for electrochemical deposition.

The overhead conductor can be made of conductive wires of metal or metal alloy. Examples include copper and aluminum and the respective alloys. Aluminum and its alloys are advantageous for an overhead conductor due to their lighter weight.

Electrochemical deposition of a metal oxide is one method for coating the surface of an overhead conductor. Electrochemical coating compositions using an electrochemical deposition process can include, for example, those found in U.S. Pat. Nos. 8,361,630, 7,820,300, 6,797,147 and 6,916,414; U.S. Patent Application Publication Nos. 2010/

0252241, 2008/0210567, 2007/0148479; and WO 2006/136335A1; which are each incorporated herein by reference in their entirety.

One method for forming a metal oxide coated aluminum overhead conductor can include the steps of: providing an anodizing solution comprising an aqueous water soluble complex of fluoride and/or oxyfluoride of a metal ion selected from one or more of titanium, zirconium, zinc, vanadium, hafnium, tin, germanium, niobium, nickel, magnesium, berrilium, cerium, gallium, iron, yttrium and boron, placing a cathode in the anodizing solution, placing the surface of the overhead conductor as an anode in the anodizing solution, applying a current across the cathode and the anode through the anodizing solution for a period of time effective to coat the aluminum surface, at least partially, with a metal oxide on the surface of the surface of the conductor to form a coating. Such coatings having a metal oxide can include a ceramic coating.

In one embodiment, electrochemical deposition of the coating includes maintaining an anodizing solution at a temperature between 0° C. and 90° C.; immersing at least a portion of the surface of the overhead conductor in the anodizing solution; and applying a voltage to the overhead conductor. The anodizing solution can be contained within a bath or a tank.

The current passed through a cathode, anode and anodizing solution can include pulsed direct current, non-pulsed direct current and/or alternating current. When using pulsed current, an average voltage potential can generally be not in excess of 600 volts. When using direct current (DC), suitable range is 10 to 400 Amps/square foot and 150 to 600 volts. In a certain embodiment, the current is pulsed with an average voltage of the pulsed direct current is in a range of 150 to 600 volts; in a certain embodiment in a range of 250 to 500 volts; in a certain embodiment in a range of 450 volts. Non-pulsed direct current is desirably used in the range of 200-600 volts.

A number of different types of anodizing solutions can be used. For example, a wide variety of water-soluble or water-dispersible anionic species containing metal, metalloid, and/or non-metal elements are suitable for use as components of the anodizing solution. Representative elements can include, for example, titanium, zirconium, zinc, vanadium, hafnium, tin, germanium, niobium, nickel, magnesium, berrilium, cerium, gallium, iron, yttrium and boron and the like (including combinations of such elements). In certain embodiments, components of the anodizing solution are titanium and/or zirconium.

In one embodiment, the anodizing solution can contain water and at least one complex fluoride or oxyfluoride of an element selected from the group consisting of titanium, zirconium, zinc, vanadium, hafnium, tin, germanium, niobium, nickel, magnesium, berrilium, cerium, gallium, iron, yttrium and boron. In certain embodiments such elements are titanium and/or zirconium. In certain embodiments, the coating can further contain IR reflective pigments.

In another embodiment, a method for making an overhead conductor can include providing of a metal oxide coating. The method can include providing an anodizing solution containing water, a phosphorus containing acid and/or salt, and one or more additional components selected from the group consisting of: water-soluble complex fluorides, water-soluble complex oxyfluorides, water-dispersible complex fluorides, and water-dispersible complex oxyfluorides of elements selected from the group consisting of titanium and zirconium, placing a cathode in the anodizing solution, placing the overhead conductor having a surface of an aluminum or aluminum alloy as an anode in the anodizing solution, passing a pulsed current across the cathode and the anode through the anodizing solution for a period of time effective to form a titanium oxide or zirconium oxide coating on at least a surface of the overhead conductor.

Electrochemical deposition of a metal oxide coating can be achieved either directly on the finished conductor or coating individual conductive wires separately before stranding the coated individual wires to make the overhead conductor. In certain embodiments, it is possible to have all of the wires of the conductor surface coated, or more economically, via another embodiment, only having the outer most wires of the conductor surface coated. In another embodiment, the electrochemical deposition coating can be applied only to the outer surface of the overhead conductor. Here, the conductor itself is stranded and made into final form before electrochemical deposition. Electrochemical deposition can be done by batch process, semi-continuous process, continuous process, or combinations of these processes.

FIGS. 1, 2, 3, and 4 illustrate various bare overhead conductors according to various embodiments incorporating a coated surface.

As seen in FIG. 1, an overhead conductor 100 generally includes a core 110 of one or more wires, round conductive wires 130 around the core 110, and a coating layer 120. The core 110 can be formed from any of a variety of suitable materials including, for example, steel, invar steel, carbon fiber composite, or any other material providing strength to the conductor 100. The conductive wires 130 can be made from a conductive material, such as copper, copper alloy, aluminum, or aluminum alloy. Such aluminum alloys can include aluminum types 1350, 6000 series alloy aluminum, or aluminum-zirconium alloy, for example.

Figure 2:
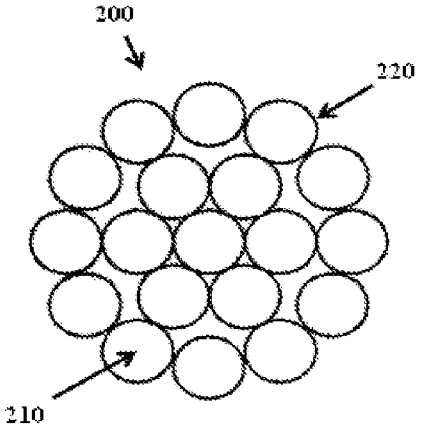
FIG. 2 is a cross-sectional view of an overhead conductor in accordance with another embodiment.

As seen in FIG. 2, an overhead conductor 200 can generally include round conductive wires 210 and a coating layer 220. Again, in certain embodiments, the conductive wires 210 can be made from a conductive material, such as copper, copper alloy, aluminum, or aluminum alloy. Such aluminum alloys can include aluminum types 1350, 6000 series alloy aluminum, or aluminum-zirconium alloy, for example.

Figure 3:
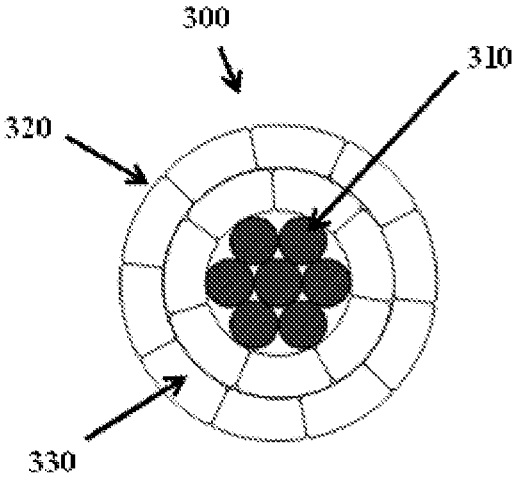
FIG. 3 is a cross-sectional view of an overhead conductor in accordance with yet another embodiment.

As seen in FIG. 3, an overhead conductor 300 can generally include a core 310 of one or more wires, trapezoidal shaped conductive wires 330 around the core 310, and a coating layer 320. The core 310 can be formed from any of a variety of suitable materials including, for example, steel (e.g. invar steel), aluminum alloy (e.g. 600 series aluminum alloy), carbon fiber composite, glass fiber composite, carbon nanotube composite, or any other material providing strength to the overhead conductor 300. Again, in certain embodiments, the conductive wires 330 can be made from a conductive material, such as copper, copper alloy, aluminum, or aluminum alloy. Such aluminum alloys can include aluminum types 1350, 6000 series alloy aluminum, or aluminum—zirconium alloy, for example.

Figure 4:
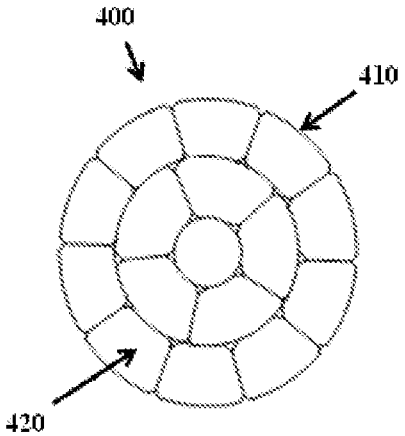
FIG. 4 is a cross-sectional view of an overhead conductor in accordance with still another embodiment.

As seen in FIG. 4, an overhead conductor 400 is generally shown to include trapezoidal-shaped conductive wires 420 and a coating layer 410. Again, in certain embodiments, the conductive wires 420 can be made from a conductive material, such as copper, copper alloy, aluminum, or aluminum alloy. Such aluminum alloys can include aluminum types 1350, 6000 series alloy aluminum, or aluminum—zirconium alloy, for example.

Composite core conductors can beneficially provide lower sag at higher operating temperatures and higher strength to weight ratio. Reduced conductor operating temperatures due to surface modification can further lower sag of the conductors and lower degradation of polymer resin in the composite core.

The surface modification described herein can also be applied in association with conductor accessories and overhead conductor electrical transmission related products and parts, for the purpose of achieving temperature reduction. Examples include deadends/termination products, splices/joints products, suspension and support products, motion control/vibration products (also called dampers), guying products, wildlife protection and deterrent products, conductor and compression fitting repair parts, substation products, clamps and other transmission and distribution accessories. Such products are commercially available from a number of manufacturers such as Preformed Line Products (PLP), Cleveland, Ohio, and AFL, Duncan, S.C.

The electrochemical deposition coating can have a desired thickness on the surface of the overhead conductor. In certain embodiments, this thickness can be from about 1 micron to about 100 microns; in certain embodiments from about 1 micron to about 25 microns; and in certain embodiments, from about 5 microns to about 20 microns. The thickness of the coating can be surprisingly even along the conductor. For example, in certain embodiments, the thickness can have a variation of about 3 microns or less; in certain embodiments, of about 2 microns or less; and in certain embodiments, of about 1 micron or less. Such electrochemical deposition coatings as described herein can be non-white in color. In certain embodiments, the color of the electrochemical deposition coatings can range in color from blue-grey and light grey to charcoal grey depending upon the coating thickness and relative amounts of metal oxides, such as titanium oxide and/or zinc oxide. In certain embodiments, such coatings can also be electrically non-conductive. As used herein, "electrically non-conductive" means volume resistivity greater than or equal to $1\times10^4$ ohm-cm.

Without further description, it is believed that one of ordinary skill in the art can, using the preceding description and the following illustrative examples, make and utilize the coatings and overhead conductors as described herein and practice the claimed methods. The following examples are given to further illustrate the claimed invention. It should be understood that the claimed invention is not to be limited to the specific conditions or details described in the cited examples.

Figure 5:
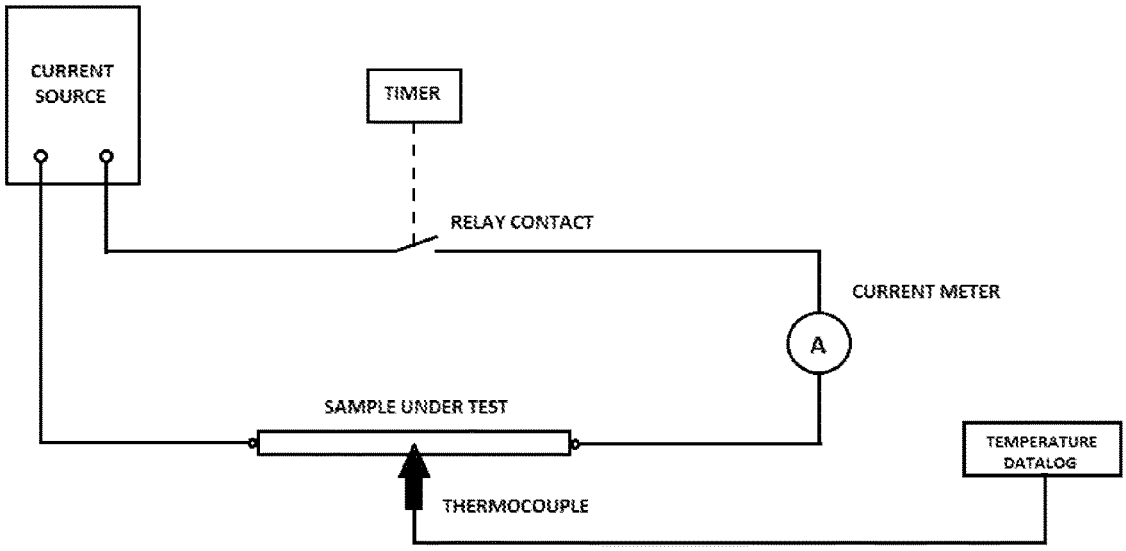
FIG. 5 is a test setup to measure the temperature of coated and uncoated energized aluminum substrates, in accordance with an embodiment.

Experimental Set-Up to Measure Effect of Coating on Operating Temperature of Conductor An experimental set-up to measure the effectiveness of an electrochemical deposition coating to reduce operating temperature of a conductor is prepared as described below. A current is applied through coated and uncoated samples. The coated sample can be a metal oxide coated aluminum or aluminum alloy substrate. The uncoated sample can be a similar aluminum or aluminum alloy substrate, but uncoated. The test apparatus is shown in FIG. 5 and mainly includes a 60 Hz AC current source, a true RMS clamp-on current meter, a temperature datalog recording device, and a timer. Testing was conducted within a 68" wide×33" deep windowed safety enclosure to control air movement around the sample. An exhaust hood was located 64" above the test apparatus for ventilation.

The sample to be tested was connected in series with the AC current source through a relay contact controlled by the timer. The timer was used to control the time duration of the test. The 60 Hz AC current flowing through the sample was monitored by the true RMS clamp-on current meter. A thermocouple was used to measure the surface temperature of the sample. Using a spring clamp, the tip of the thermocouple was kept firmly in contact with the center surface of the sample. The thermocouple was monitored by the temperature datalog recording device to provide a continuous record of temperature.

Both uncoated and coated substrate samples were tested for temperature rise on this experimental set-up under identical conditions. The current was set at a desired level and was monitored during the test to ensure that a constant current was flowing through the samples. The timer was set at a desired value; and the temperature datalog recording device was set to record temperature at a recording interval of one reading per second.

The metal component for the uncoated and coated samples was from the same source material and lot of Aluminum 1350. The finished dimensions of the uncoated sample was 12.0"(L)×0.50"(W)×0.027"(T). The finished dimensions of the coated sample was 12.0"(L)×0.50"(W)×0.028"(T). The increase in thickness was due to the thickness of the applied coating.

The uncoated sample was firmly placed into the test set-up and the thermocouple secured to the center portion of the sample. Once this was completed, the current source was switched on and was adjusted to the required ampacity load level. Once this was achieved the power was switched off. For the test itself, once the timer and the temperature datalog recording device were all properly set, the timer was turned on to activate the current source starting the test. The desired current flowed through the sample and the temperature started rising. The surface temperature change of the sample was automatically recorded by the temperature datalog recording device. Once the testing period was completed, the timer automatically shut down the current source ending the test.

Once the uncoated sample was tested, it was removed from the set-up and replaced by the coated sample. The testing resumed making no adjustments to the AC current source. The same current level was passed through the uncoated and coated samples.

The temperature test data was then accessed from the temperature datalog recording device and analyzed using a computer. Comparing the results from the uncoated sample test with that from the coated test was used to determine the comparative emissivity effectiveness of the coating material.

Methodology to Measure Flexibility and Thermal Stability of Coating

To study thermal stability of an electrochemical deposition coating, coated samples were places in air circulation oven at a temperature of 325° C. for a period of 1 day and 7 days. After the thermal aging was complete, the samples were placed at room temperature for a period of 24 hrs. The samples were then bent on different cylindrical mandrels sized from larger diameter to smaller diameter and the coatings were observed for any visible cracks at each of the mandrel sizes. Results were compared with the flexibility of the coating prior to thermal aging.

EXAMPLES

Comparative Example 1

Uncoated strips of aluminum (ASTM grade 1350; Dimensions: 12.0"(L)×0.50"(W)×0.028"(T)) were tested for operating temperature as per the test method described above. The test set up is illustrated in FIG. 5.

Inventive Example 1

The same strips of aluminum described in Comparative Example 1 were coated with an electrochemical deposition coating of titanium oxide (commercially available as Alodine EC2 from Henkel Corporation). The sample dimensions prior to coating were 12.0"(L)×0.50"(W)×0.028"(T). The thickness of the coating was 12-15 microns. The sample was then tested for reduction in operating temperature by the test method described above. The titanium oxide coated sample was found to demonstrate significantly lower operating temperature compared to the uncoated sample (Comparative Example 1), as summarized in Table 1 below.

TABLE 1

Operating temperature reduction data for coated & uncoated sample

| | Comparative Example 1 | Inventive Example 1 |
|---|---|---|
| Substrate | Aluminum 1350 | Aluminum 1350 |
| Coating | None | Titanium Oxide |
| Conductor Temperature at 95 Amp current (° C.) | 127 | 103 |

Comparative Example 2

The same strips of aluminum described in Comparative Example 1 were anodized. The anodized layer thickness was 8-10 microns. The flexibility of the anodized coating was tested by performing the mandrel bend test as described above. The flexibility test was also conducted after thermal aging at 325° C. for 1 day and 7 days.

Comparative Example 3

The same strips of aluminum described in Comparative Example 1 were coated with a coating containing 40% sodium silicate solution in water (75% by weight) and zinc oxide (25% by weight) by brush application. The coating thickness was about 20 microns. Flexibility of the coating was tested by performing the mandrel bend test as described above. The flexibility test was also conducted after thermal aging at 325° C. for 1 day and 7 days.

The flexibility test data is summarized in Table 2 below. The sample with the electrochemically deposited titanium oxide coating showed significantly better flexibility compared to each of the anodized coating and the sodium silicate with ZnO brush coating. Moreover there was no change in the flexibility of the titanium oxide coating with thermal aging at 325° C. for 1 and 7 days.

TABLE 2

Flexibility and thermal stability data for differently coated samples

| | Comparative Example 2 | Comparative Example 3 | Inventive Example 1 |
|---|---|---|---|
| Substrate | Aluminum 1350 | Aluminum 1350 | Aluminum 1350 |
| Coating | Anodized | Sodium silicate + Zinc Oxide | Titanium Oxide |
| Application of Coating | Anodized | Brushed | Electrochemical Deposition |
| Before ageing | 8" mandrel | 4" mandrel | 1" mandrel |

TABLE 2-continued

Flexibility and thermal stability data for differently coated samples

| | Comparative Example 2 | Comparative Example 3 | Inventive Example 1 |
|---|---|---|---|
| (Initial) | Cracks observed | Cracks observed | Pass - no cracks observed |
| After heat ageing at 325° C. for 1 day | 8" mandrel Cracks observed | 4" mandrel Cracks observed | 1" mandrel Pass - no cracks observed |
| After heat ageing at 325° C. for 7 days | 8" mandrel Cracks observed | 4" mandrel Cracks observed | 1" mandrel Pass - no cracks observed |

While particular embodiments have been chosen to illustrate the claimed invention, it will be understood by those skilled in the art that various changes and modifications can be made therein without departing from the scope of the claimed invention as defined in the appended claims.

What is claimed is:

1. An overhead conductor comprising an assembly including one or more conductive wires formed of aluminum or aluminum alloy, wherein the assembly comprises an outer surface directly coated with an electrochemical deposition coating such that the electrochemical deposition coating contacts at least one of the one or more conductive wires, the electrochemical deposition coating consisting essentially of metal oxide, the electrochemical deposition coating comprising a first metal oxide, wherein the first metal oxide comprises titanium oxide, zirconium oxide, zinc oxide, niobium oxide, vanadium oxide, molybdenum oxide, copper oxide, nickel oxide, magnesium oxide, beryllium oxide, cerium oxide, boron oxide, gallium oxide, hafnium oxide, tin oxide, iron oxide, yttrium oxide or combinations thereof; wherein the electrochemical deposition coating defines a single layer having a thickness of 12 microns to 25 microns; wherein the electrochemical deposition coating is the outermost layer of the overhead conductor; and wherein the operating temperature of the overhead conductor is lower than the operating temperature of a bare conductor by at least 5° C., when uncoated and the same current is applied.

2. The overhead conductor of claim 1, wherein the electrochemical deposition coating further comprises a second metal oxide, wherein the second metal oxide is aluminum oxide.

3. The overhead conductor of claim 1, wherein the first metal oxide comprises titanium oxide, zirconium oxide or combinations thereof.

4. The overhead conductor of claim 1, wherein the electrochemical deposition coating is non-white.

5. The overhead conductor of claim 1, wherein the single layer has a thickness of 12 microns to 15 microns.

6. The overhead conductor of claim 1, wherein the electrochemical deposition coating has a thickness variation of 3 microns or less.

7. The overhead conductor of claim 1, wherein the operating temperature of the overhead conductor is lower than the operating temperature of a bare conductor by at least 10° C., when uncoated and when the operating temperatures measured are above 100° C. and the same current is applied.

8. The overhead conductor of claim 1, wherein the power transmission loss exhibited by the overhead conductor is lower than the power transmission loss exhibited by a bare conductor, when uncoated and the same current is applied.

9. The overhead conductor of claim 1, wherein the current carrying capacity of the overhead conductor is higher than the current carrying capacity of a bare conductor, when uncoated and the same current is applied.

10. The overhead conductor of claim 1, wherein the one or more conductive wires are formed from an aluminum alloy selected from the group consisting of 1350 alloy aluminum, 6000-series alloy aluminum, aluminum- zirconium alloy, and combinations thereof.

11. The overhead conductor of claim 1, wherein at least some of the one or more conductive wires have trapezoidal cross-sections.

12. The overhead conductor of claim 1, wherein the one or more conductive wires surround a core comprised of steel, carbon fiber composite, glass fiber composite, carbon nanotube composite, or aluminum alloy.

13. The overhead conductor of claim 1, wherein each of the conductive wires is individually coated with the electrochemical deposition coating.

14. The overhead conductor of claim 1, wherein a portion of each of the conductive wires is coated with the electrochemical deposition coating.

15. The overhead conductor of claim 1, wherein the electrochemical deposition coating is electrically non-conductive.

16. An overhead conductor comprising an assembly including one or more conductive wires formed of aluminum or aluminum alloy, wherein the assembly comprises an outer surface directly coated with an electrochemical deposition coating such that the electrochemical deposition coating contacts at least one of the one or more conductive wires, the electrochemical deposition coating consisting essentially of titanium oxide, zirconium oxide or combinations thereof, wherein the electrochemical deposition coating defines a single layer having a thickness from 12 microns to 25 microns; wherein the electrochemical deposition coating is the outermost layer of the overhead conductor; and wherein the operating temperature of the overhead conductor is lower than the operating temperature of a bare conductor by at least 5° C., when uncoated and the same current is applied.

* * * * *